US005564128A

United States Patent [19]

Richardson

[11] Patent Number: 5,564,128

[45] Date of Patent: Oct. 15, 1996

[54] SAFETY HELMET WITH ELECTROLUMINESCENT LAMP

[76] Inventor: Patrick J. Richardson, 2127 Brecken Dell Ct., Frederick, Md. 21702

[21] Appl. No.: 316,447

[22] Filed: Oct. 3, 1994

[51] Int. Cl.[6] ..... A42B 3/04

[52] U.S. Cl. ..... 2/422; 2/5; 362/105

[58] Field of Search ..... 2/5, 410, 411, 2/422, 424, 209.13, 905, 906; 362/103, 105, 106

[56] References Cited

U.S. PATENT DOCUMENTS

| | | | |
|---|---|---|---|
| 3,142,833 | 7/1964 | Bosley et al. | 2/5 |
| 4,092,704 | 5/1978 | Malm | 362/106 |
| 4,317,161 | 2/1982 | Aiello, Jr. | 362/103 |
| 4,521,831 | 6/1985 | Thayer | 362/106 |
| 4,945,458 | 7/1990 | Batts et al. | 362/106 |
| 4,959,637 | 9/1990 | Woods et al. | 340/573 |
| 5,257,417 | 11/1993 | Oleson | 2/5 |
| 5,327,587 | 7/1994 | Hurwitz | 2/422 |
| 5,329,637 | 7/1994 | Walker | 2/5 |
| 5,408,393 | 4/1995 | Becker | 362/105 |
| 5,416,675 | 5/1995 | DeBeaux | 362/106 |
| 5,424,922 | 6/1995 | Wise | 362/103 |
| 5,426,792 | 6/1995 | Murasko | 2/422 |
| 5,438,494 | 8/1995 | Harlan | 362/106 |

*Primary Examiner*—Michael A. Neas

*Attorney, Agent, or Firm*—Morton J. Rosenberg; David I. Klein

[57] ABSTRACT

This invention directs itself to a safety helmet to provide visibility of the wearer in a hostile environment such as smoke, dust and fog-like conditions. The safety helmet (10) includes a crown (18) and a brim section (20) surrounding the crown (18) and formed in one-piece formation with the crown (18). A flexible electroluminescent lamp rid (16) is mounted on the crown (18) or a transparent face shield (22) to provide electroluminescent light emission. The flexible electroluminescent lamp strip member (16) is electrically coupled to an electroluminescent actuating circuit (26) mounted on a rear section (14) of the safety helmet (10). Actuation of the electroluminescent lamp strip (16) allows for visual identification of the wearer and allows others in the vicinity to positionally locate the wearer of the electroluminescent lamp strip member (16).

11 Claims, 6 Drawing Sheets

SAFETY HELMET WITH ELECTROLUMINESCENT LAMP

BACKGROUND OF THE INVENTION

1. Field the Invention

This invention is related to a safety helmet which when worn by a user allows for positionally locating and visual identification of the wearer in a hostile environment. In particular, this invention in one embodiment directs itself to a safety helmet which provides for an electroluminescent strip member conformed and attached to a face shield of a safety helmet. In another embodiment, the subject system directs itself to a highly visible system where an electroluminescent lamp strip member is fixedly secured to the crown of the safety helmet. More in particular, this invention relates to a portable system which is incorporated within a safety helmet to allow the wearer complete flexibility in his or her movements. Still further, this invention relates to a safety helmet system which incorporates an electroluminescent lamp strip member electrically coupled to an electrical actuating circuit releasably mounted on the brim of the safety helmet. Still further, this invention directs itself to a safety helmet whereby the electrical actuating circuit is enclosed within an electrical actuation housing which is inserted within a pouch member and releasably coupled to the underside of the brim of the safety helmet. Further, this invention relates to a system whereby the electrical actuating circuit may be coupled to a personal alert safety system to provide a blinking of the electroluminescent lamp strip member when no motion is detected from the user over some predetermined time. Still further, due to the fact that the electroluminescent lamp strip member may be actuated to emit different and particular colors, the safety helmet may be used for identification of the wearer in a hostile environment.

2. Prior Art

Safety lights mounted on various parts of a user's body including head coverings is known in the prior art. The best prior art known to the Applicant includes U.S. Pat. Nos. 5,245,516; 5,151,678; 4,945,458; 4,999,936, D310,434; 5,111,366; 4,319,308; 3,963,917; 5,245,517; and, 5,268,827.

In some prior art systems such as that shown in U.S. Pat. No. 4,945,458, there are provided fireman's helmets with front and rear lights. The helmets include both a front light assembly and a rear light assembly however, such provide for halogen light bulbs which provide for relatively high heat output and do not provide for the advantages of an electroluminescent light emission in hostile environments as is provided by the subject invention.

Prior art systems such as U.S. Pat. No. 5,111,366 are directed to a head covering having illuminated indicia formed thereon, however, such headdress merely includes an illuminated front panel which is edge-lit by a plurality of lamps or light emitting diodes powered from a battery source. However, such do not provide for the necessary electroluminescent light strip member in combination with the electrically actuating mechanism removably secured to a rear section of the brim of an overall helmet system.

Prior art systems such as U.S. Pat No. 5,151,678 provide for electroluminescent safety belts where such provides for battery electrical operation located within a portion of the belt. However, such systems do not provide for the combination of the electroluminescent light strip and electrical actuating circuitry removably mounted to a safety helmet as is provided in the subject invention for the purposes and objectives herein described.

SUMMARY OF THE INVENTION

A safety helmet is provided which includes a crown and a brim surrounding a lower section of the crown with the crown and brim formed in one-piece formation. A flexible electroluminescent lamp strip is fixedly secured to the safety helmet for emitting electromagnetic radiation within a visible bandwidth of the electromagnetic energy spectrum. An electrically actuating circuit is electrically coupled to the electroluminescent lamp strip and is releasably secured to a lower surface of the brim at a rear section thereof in order to maintain complete portability of the safety helmet with no external connections being necessary.

An object of the present invention is to provide a safety helmet which will allow visual positional locating of a wearer of the safety helmet in a hostile environment such as a smoke filled environment, fog conditions or other like hostile environments.

Another object of the present invention is to provide a safety helmet where a particular color identification will identify the wearer of the safety helmet.

Still another object of the invention is to provide a safety helmet utilizing a low power, high visual output electroluminescent light emission system.

Further, an object of this invention is to provide a completely portable light emission system mounted directly to a helmet without external connection

DESCRIPTION OF THE PREFERRED EMBODIMENTS

Figure 1:
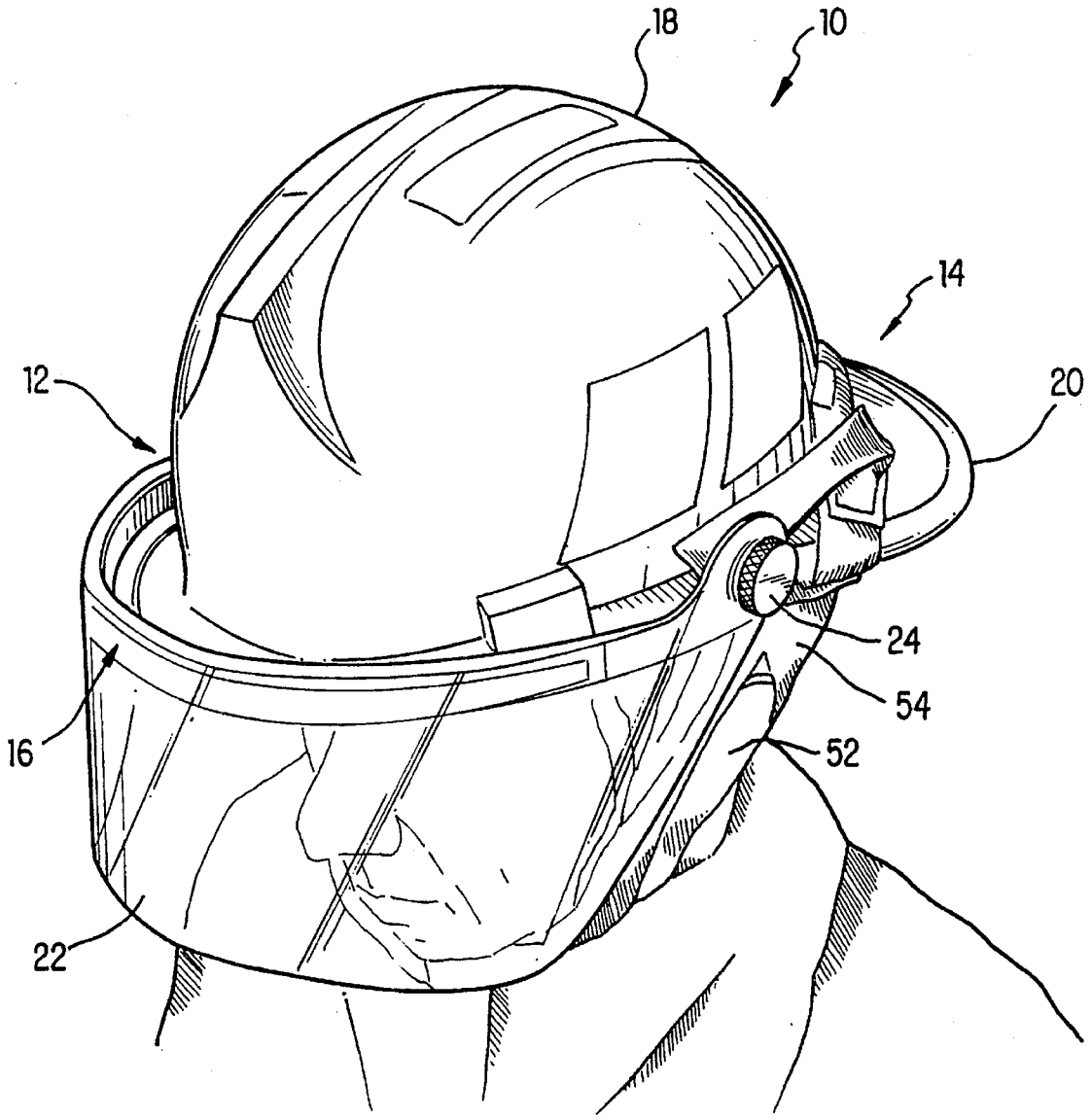
FIG. 1 is a perspective view of the safety lamp of the subject invention concept showing an electroluminescent strip member mounted to a face shield of the safety helmet.
Figure 2:
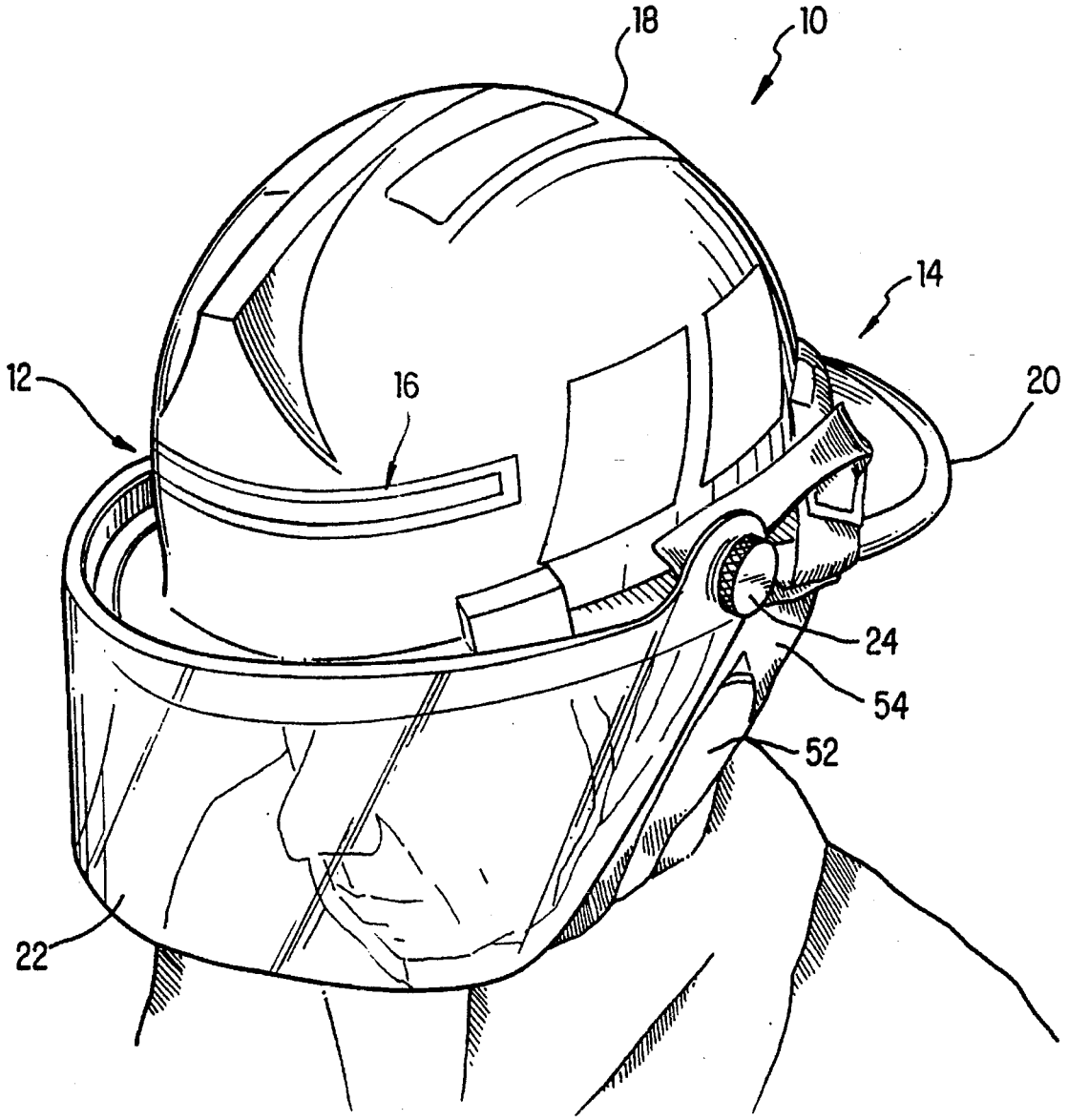
FIG. 2 is a perspective view of the safety helmet of the subject invention concept showing the electroluminescent lamp strip fixedly secured to the crown of the safety helmet.

Referring now to FIGS. 1–4, there is shown safety helmet 10 which has particular adaptability for use by firemen in areas where the fireman's visual acuity is lowered due to an environment which has a high degree of smoke and other contaminants which impedes the fireman's ability to visually assess the situation. It is to be understood, that safety helmet 10 may be used in a wide variety of manners for indicating the presence of a person in a particular environment, identification of a person and signaling of a warning or call for help. These objectives of safety helmet 10 are paramount to conditions where the lighting conditions are of a nature which do not allow efficient visual assessment and in areas where the external environment is of a nature which does not provide for the visual acuity necessary to provide an adequate visual survey of the conditions in the environment. Due to the extreme environments that a fireman must work in which includes highly heated surroundings and an environment which is highly toxic as well as provides the fireman with only a few feet of visual clarity, it has become important that firemen working in teams be able to note the presence of other firemen in the area, identify the rank of the firemen in the team and to allow for a signaling in the event that a fireman succumbs to the environment and is unable to further function.

In order to allow optimum movement of the wearer, safety helmet 10 must be portable with all warning signal systems mounted in a manner such that operation may be provided over an extended period of time. This type of system must provide the fireman or other person with an overall signaling or warning system which has a low electrical power requirement and a portability which allows the system to be mounted on the person's body or within the safety helmet 10 as will be further described in following paragraphs. Additionally, it is required that the visual system have substantially low heat output generation, due to the environment in which the person is working, which in itself may be toxic and have excessively high temperatures associated with the surrounding environment. Still further, the subject safety helmet 10 must provide for a visual system which allows for the system to be mounted on the safety helmet 10 and would provide a wide area of light emission. The wide area of visualization is necessary due to the fact that the environmental conditions are extreme and a fireman's attention must be immediately focused on the signal light emission from the safety helmet.

In order to achieve these concatenation of objectives, safety helmet 10 is based upon the use of electroluminescence to provide the warning or identification signals. Electroluminescence is a highly efficient method for the generation of light within the visible band width of the electromagnetic energy spectrum. In general, this is a generation of light in a non-metallic solid through the application of an electric field. As opposed to incandescent lighting, electroluminescence is a cool light in that the brightness of the light is far above the characteristic of the temperature which is the basis of generation of light from an incandescent light bulb.

Primary electronic states of non-metallic solids generally include two bands of allowed states separated by what is termed a forbidden gap where only states due to the impure atoms or lattice imperfections exist. At normal temperatures the higher band which is called the conduction band is generally empty except for a small number of moving electrons. The lower band, commonly called the valence band is filled with electrons with the exception of vacant states which are commonly called holes. Due to the interactions with thermal vibrations, electrons in the conduction band fall to a low energy edge and holes in the valence band rise to a high energy edge. When the excess electrons and holes are produced and brought into proximity by the action of an applied electric field, the electrons will spontaneously fall into or recombine with the holes. This recombination event releases energy comparable to the particular band gap and such is dissipated in one form as radiation and is known as electroluminescence.

Safety helmet 10 as shown in FIGS. 1–4 includes safety helmet front section 12 and safety helmet back section 14. Safety helmet 10 may be a standard fireman's helmet and includes electroluminescent lamp strip 16 which is fixedly secured to safety helmet 10 and emits electromagnetic radiation within a particular visible band width of the electromagnetic energy spectrum. The particular electroluminescent lamp strip member 16 used in the subject invention concept is well known in the art and is commercially available. As described for this safety helmet 10, electroluminescent lamp strip member 16 is an electroluminescent lamp produced by QUANTEX CORPORATION having a business address in Rockville, Md. Electroluminescent lamp strip member 16 is flexible in nature and may be conformed to the outer contour of safety helmet 10. Strip member 16 converts electrical energy into light for luminescence and where a DC electric field is applied to a thin phosphor, such produces light. The light emitting phosphor is generally sandwiched between a pair of conductive electrodes with one of the electrodes being optically clear or transparent to allow the light to pass therefrom. When an AC voltage is applied to the electrodes, the electric field causes the phosphor to charge and discharge, resulting in the emission of light during each cycle. Since the number of light pulses depends on the voltage cycling frequency and the intensity of the pulses depends on the amount of applied voltage, the brightness of the electroluminescent lamp strip 16 may be increased by increasing operating voltage and frequency. In practice, the components of lamp strip 16 are mounted between clear strips which may be mylar strips adaptable to be secured to safety helmet 10.

Safety helmet 10 includes crown portion 18 and brim portion 20 as shown. In general, both the crown portion 18 and the brim portion 20 are formed by a hardened material which is not important to the inventive concept as herein described with the exception that it be able to maintain structural integrity within the environment proposed. Crown portion 18 and brim portion 20 are generally rigid structures and are formed in one-piece formation to provide the overall operational safety helmet 10 as herein described. Additionally, in most conditions, safety helmet 10 includes substantially transparent face shield 22 to protect the user's face from the extreme external environment encountered. Transparent shield 22 is generally rotatably mounted to crown portion 18 through pivot pin knobs 24 which allow the user to maintain substantially transparent face shield 22 in the line of sight of the user or to pull such back at least partially over the top of crown portion 18.

Figure 4:
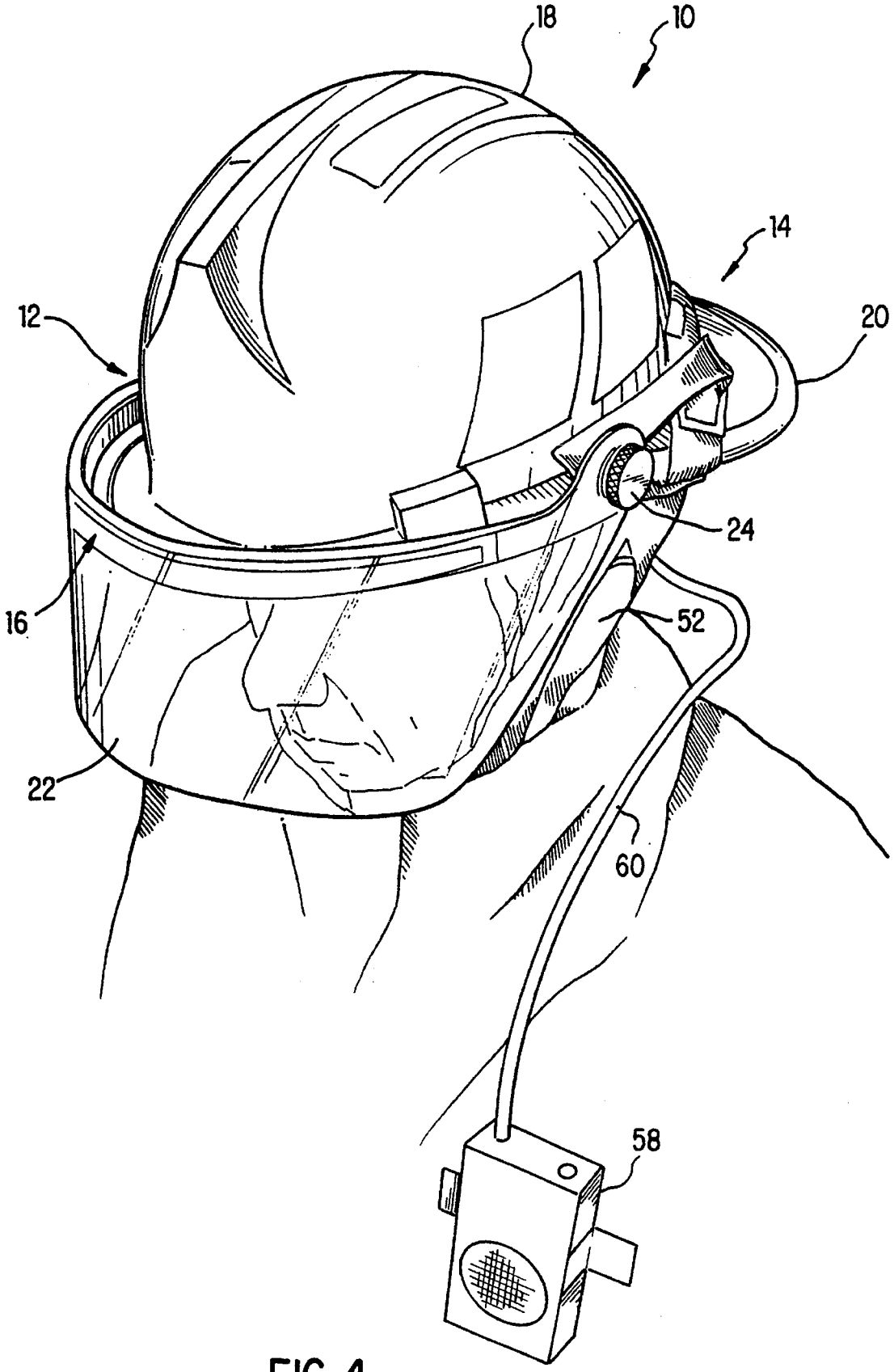
FIG. 4 is a perspective view of the safety helmet showing a personal assist security system mounted to the body of a wearer and coupled to the safety helmet.

As can be seen in FIG. 1 and FIG. 4, electroluminescent lamp strip member 16 is mounted to either an internal surface or an external surface of substantially transparent shield 22. Additionally, in FIG. 2 it is seen that electroluminescent lamp strip 16 is mounted to safety helmet front section 12 on an outer surface thereof. Alternatively, electroluminescent lamp strip member 16 may be fixedly secured to both transparent shield 22 as well as safety helmet front section 12.

Electroluminescent lamp strip member 16 may be conformed to either the external contoured surface of safety helmet front section 12 or conformed to the internal or external surface of transparent shield 22. Additionally, electroluminescent lamp strip member 16 which is flexible in nature may be adhesively secured through an appropriate adhesive bonding technique not important to the inventive concept as herein described with the exception that the compound being used for adhesive securement be adaptable to the extreme environmental conditions necessarily encountered by the user. Thus, flexible strip member 16 may be glued, or epoxied in the normal manner to the hard surface of front section 12 or to the hard surface of transparent shield 22

Figure 5:
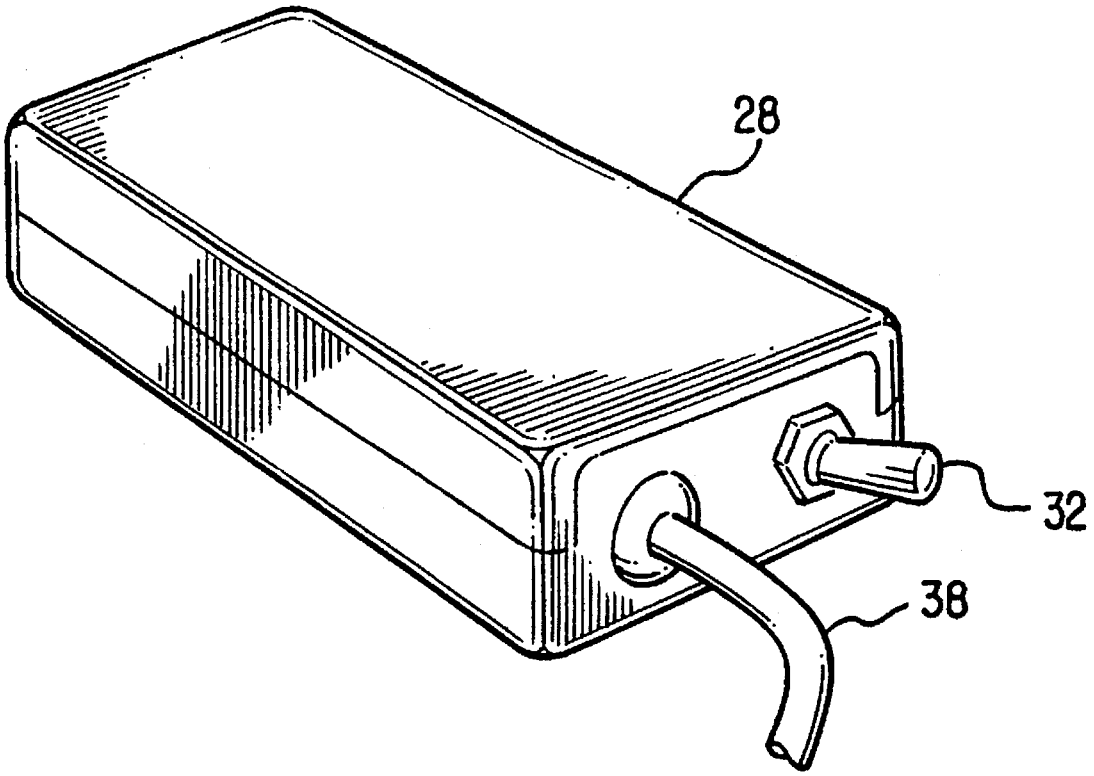
FIG. 5 is a perspective view of the electrical actuation housing containing the circuitry for actuating the electroluminescent lamp strip member; and, FIG. 6 is a schematic electrical representation of the circuitry for electrically actuating the electroluminescent lamp strip member.
Figure 6:
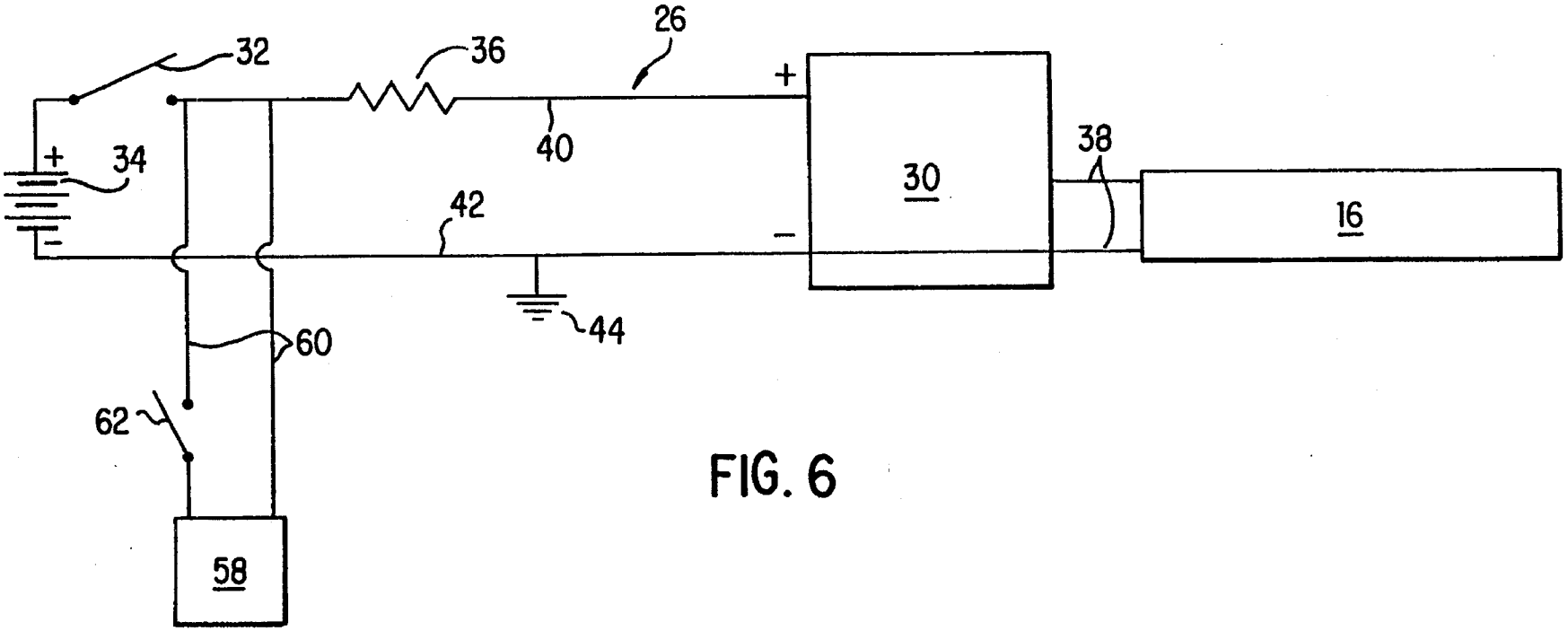

Safety helmet 10 further includes electrical actuating mechanism 26 to electrically actuate electroluminescent lamp strip member 16. Electrical actuating mechanism 26 is removably mounted to safety helmet 10 and electrically coupled to electroluminescent lamp strip 16 as will be described in following paragraphs. Electrical actuating mechanism 26 includes electrical actuation housing 28 shown in FIGS. 3 and 5. Contained within electrical actuation housing 28 is the electrical actuation circuit 26 as shown in FIG. 6 which includes inverter 30 which is located within electrical actuation housing 28 for converting a DC signal to an AC signal for input to electroluminescent lamp strip member 16. As shown in FIG. 6, battery 34 is electrically coupled to inverter 30 through resistor 36 and is actuated by battery switch 32. In this manner, a DC signal may be inserted to inverter 30 to provide the necessary output AC signals on lines 38 to electroluminescent lamp strip 16 to provide the necessary light emission. As shown in FIG. 6, DC battery 34 is coupled to inverter 30 through lead lines 40, 42 having a common ground 44.

The particular characteristics of battery 34 and resistor 36 are not important to the inventive concept as herein described and such may be adjusted to allow for a proper voltage drop applied to inverter 30 with the exception that battery 34 be of such volume that it be acceptable within electrical actuation housing 28. By closing switch 32, electroluminescent lamp strip member 16 is actuated to produce appropriate light emission. The fireman or other user may open switch 32 as is shown in FIG. 6, to turn off the power generation and obviously extend the life of the overall operating system.

One of the important considerations of electrical actuation housing 28 and the contained electrical actuating mechanism 26 is the fact that such be mounted on safety helmet 10 during operation and allows for portability of the overall system. The portability concept is combined with the requirement that a standard helmet be used as the safety helmet 10. Thus, it is required that the electrical actuation housing 28 containing electrical actuating mechanism 26 be mounted on safety helmet 10 while allowing removability therefrom.

Figure 3:
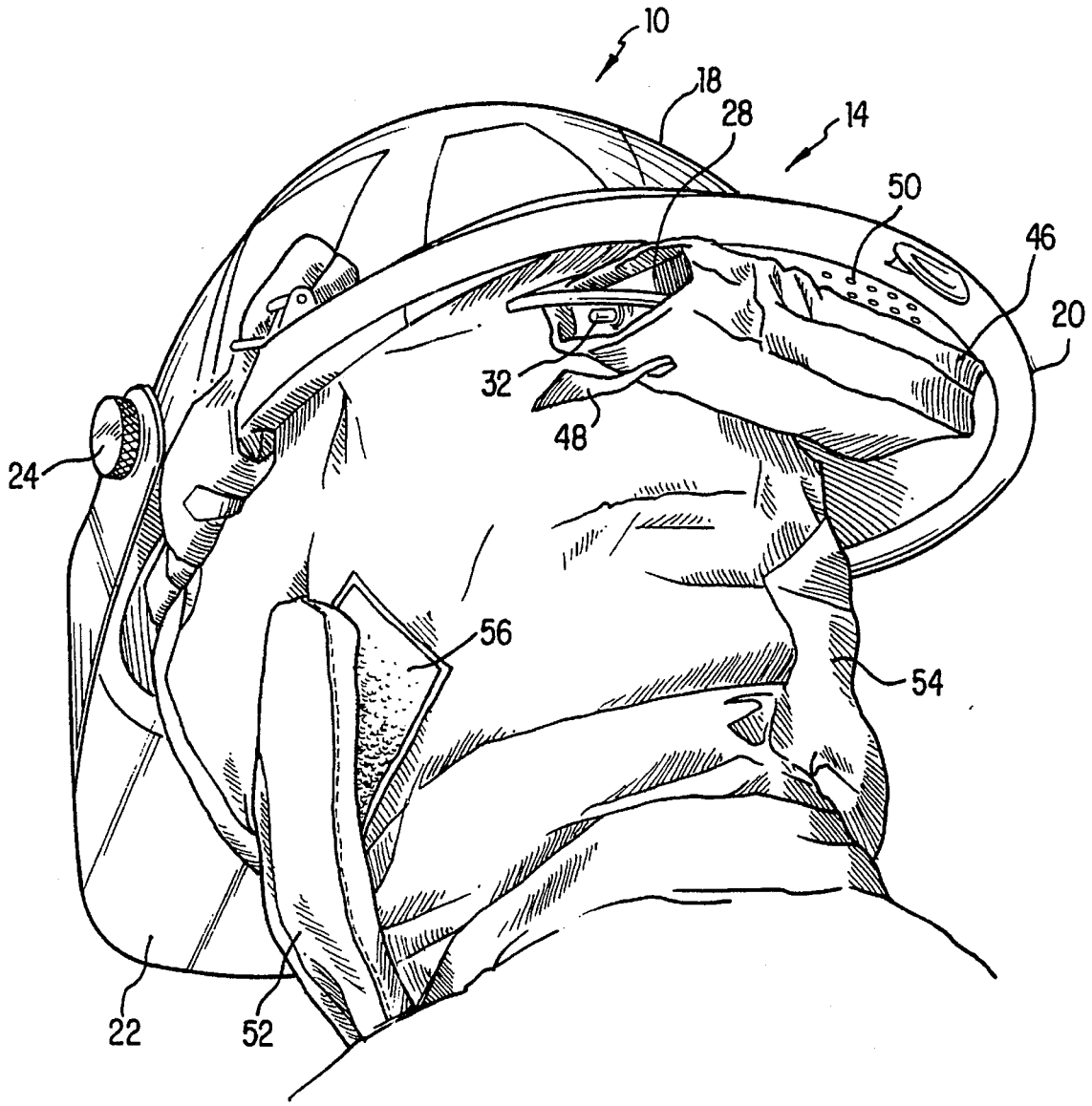
FIG. 3 is a perspective view of a rear section of the safety helmet showing an electrical luminescent actuating system removably secured to an under surface of a back section of the safety helmet brim.

In order to accomplish this concatenation of objectives, pouch member 46 shown in FIG. 3 is provided which allows for insert of electrical actuation housing 28 as is shown. Additionally, pouch member 46 defines a pocket within which electrical actuation housing 28 may be mounted and secured by pouch member closure 48 which may in itself be a snap fastener, hook-in-loop fastener or other type of closure device which captures electrical actuation housing 28 within the pocket defined by pouch member 46. Pouch member 46 is removably secured to a lower surface of safety helmet back section 14 through pouch hook-in-loop fastener 50 which may be a Velcro type fastening system. In this manner, pouch member 46 may be releasably secured to the inner surface of safety helmet back section 14, out of the way of the user and allowing freedom of action. When the user wishes to actuate electrical actuating mechanism 26, the entire pouch member 46 may be removed from safety helmet back section 14 and switch member 32 closed. Reattachment to the inner surface of safety helmet back section 14 is then accomplished and the system is operational.

The portability and removability of electrical actuation housing 28 from safety helmet 10 is of importance in that generally actuation may be accomplished when safety helmet 10 is mounted on the head of the user. Safety helmet 10 includes chin strap 52 which may be releasably secured to safety shroud 54 through hook-in-loop fastening system 56. As seen in FIG. 3, the user's view is blocked from pouch member 46 and a simple and quick method must be provided for removal of pouch member 46 and the enclosed electrical actuation housing 28 due to the fact that actuation of such systems is generally under extremely hazardous conditions and any attempt to remove safety helmet 10 from the user's head during such conditions may have disastrous results.

Referring now to FIG. 4 and FIG. 6, there is shown safety helmet 10 including what is commonly referred to as a personal alert safety system 58 (PASS). The personal alert safety system 58 may be mounted on the body of the user and provides an audio signal in the form of a beeping or other audio indication when the body of the user is motionless for some predetermined length of time. This type of system 58 has been used by firemen and provides some measure of safety when a fireman is hurt or otherwise immobilized for some predetermined time. However, the audio signal from the personal alert safety system 58 although having some effect, does not generally lead other firemen to the aid of an immobilized fireman in a quick and efficient manner since it is a smoke filled environment where visual contact cannot be made.

Safety helmet 10 and the attendant electrical actuating mechanism 26 for electroluminescent lamp strip member 16 may be incorporated and coupled to personal alert safety system 58 in order to provide a blinking or strobing of electroluminescent lamp strip member 16. As can be seen in FIG. 6, personal alert safety system 58 may include a switch 62 for coupling to the entire electrical actuating mechanism 26. Lead lines 60 are provided and when motion detection is not provided a pulsating DC signal may be input to inverter 30 for providing a blinking electroluminescent lamp strip member 16.

In this manner, other fire fighters will not only have an audio input as to the immobilized fireman but further will have a visual indication of the immobilized fireman. The personal alert safety system 58 as herein described is commercially available from numerous manufacturers, one of which is the DETEX CORPORATION, LIFELINE DIVISION, New Braunfels, Tex., and makes commercially available such systems under the designation of PAL 5+ and PAL 3+.

Still further, electroluminescent lamp strip member 16 provides additional advantages in that a variety of colors lay be provided for each lamp strip member 16. The particular lamp color may be determined by the particular phosphor type which include a number of colors including blue, green and yellow. Electroluminescent lamp strip member 16 allows for differing colors by blending of multiple phosphors or adding fluorescent dyes to the phosphor layer. The use of different colors for individual safety helmets 10 is of great importance due to the fact that the fire fighter's color on the safety helmet may designate the command chain. It is of importance in such hazardous environments that fire fighters are able to detect orders coming from those in command and to carry out such orders.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A safety helmet having a frontal section and a rear section, comprising:

(a) a brim portion formed on a lower portion thereof and having a frontal section and a rear section;

(b) electroluminescent lamp means fixedly secured to said safety helmet for emitting electromagnetic radiation within a visible bandwidth of the electromagnetic energy spectrum;

(c) means for electrically actuating said electroluminescent lamp means, said means for electrically actuating said electroluminescent lamp means being removably mounted to said rear section of said brim portion of said safety helmet and electrically coupled to said electroluminescent lamp means, said means for electrically actuating said electroluminescent lamp means including (a) an actuator housing, (b) inverter means located within said actuator housing for converting a DC signal to an AC signal for input to said electroluminescent lamp means, and (c) battery means disposed within said actuator housing for input of said DC signal to said inverter means; and, (d) motion sensing means electrically coupled to said electrically actuating means for strobing said electroluminescent lamp means alternately on and off responsive to detection of an absence of motion during a predetermined time interval, said means for electrically actuating said electroluminescent lamp means further including means for electrically coupling said motion sensing means intermediate said inverter means and said battery means.

2. The safety helmet as recited in claim 1 where said safety helmet includes a crown portion, said electroluminescent lamp means being fixedly secured to a frontal section of said crown portion.

3. The safety helmet as recited in claim 2 where said electroluminescent lamp means is formed of an electroluminescent flexible strip member fixedly secured to an outer surface of said frontal section of said safety helmet crown portion.

4. The safety helmet as recited in claim 3 where said electroluminescent flexible strip member is adhesively secured to said outer surface of said frontal section of said safety helmet crown portion.

5. The safety helmet as recited in claim 1 where said safety helmet includes a substantially transparent shield rotatably mounted to said frontal section of said safety helmet, said electroluminescent lamp means being fixedly secured to said substantially transparent shield.

6. The safety helmet as recited in claim 5 where said electroluminescent lamp means is formed of an electroluminescent strip member fixedly secured to said substantially transparent shield adjacent an upper surface thereof.

7. The safety helmet as recited in claim 6 where said electroluminescent strip member is adhesively secured to said substantially transparent shield.

8. The safety helmet as recited in claim 1, including a pouch member releasably secured to said rear section of said brim portion of said safety helmet.

9. The safety helmet as recited in claim 8 where said actuator housing is located within said pouch member and releasably secured thereto.

10. The safety helmet as recited in claim 15 including a pouch hook-in-loop fastener mounted on said pouch and said brim portion for releasable securement of said pouch member to said brim portion of said safety helmet.

11. The safety helmet as recited in claim 1 where said emitted electromagnetic radiation is emitted in a predetermined visible bandwidth for emitting a predetermined color.

* * * * *